US011501734B2

(12) United States Patent
Han et al.

(10) Patent No.: US 11,501,734 B2
(45) Date of Patent: Nov. 15, 2022

(54) ELECTRONIC DEVICE HAVING MULTIPLE INTERFACES AND METHOD OF DRIVING THE SAME

(71) Applicant: Samsung Display Co., Ltd., Yongin-si (KR)

(72) Inventors: Ho Seok Han, Yongin-si (KR); Jun Yong Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/932,389

(22) Filed: Jul. 17, 2020

(65) Prior Publication Data

US 2021/0065652 A1 Mar. 4, 2021

(30) Foreign Application Priority Data

Sep. 4, 2019 (KR) ..... 10-2019-0109587

(51) Int. Cl.
*G09G 5/00* (2006.01)

(52) U.S. Cl.
CPC ..... *G09G 5/006* (2013.01); *G09G 5/001* (2013.01); *G09G 2310/08* (2013.01); *G09G 2360/18* (2013.01)

(58) Field of Classification Search
CPC .... G09G 5/006; G09G 5/001; G09G 2360/18; G09G 2310/08; G09G 2330/021; G09G 2350/00; G09G 5/12; G09G 2370/02
See application file for complete search history.

(56) References Cited

U.S. PATENT DOCUMENTS

| | | | | |
|---|---|---|---|---|
| 8,878,995 | B2 * | 11/2014 | Cha | G09G 5/18 348/554 |
| 9,892,483 | B2 * | 2/2018 | Lee | G09G 5/006 |
| 10,410,586 | B2 | 9/2019 | Ahn et al. | |
| 10,467,951 | B2 * | 11/2019 | Bae | G09G 5/397 |
| 2013/0044087 | A1 * | 2/2013 | Hsu | G09G 5/003 345/204 |
| 2016/0027146 | A1 * | 1/2016 | Kim | G09G 3/3648 345/82 |
| 2019/0098401 | A1 | 3/2019 | Saha et al. | |
| 2020/0066226 | A1 | 2/2020 | Han et al. | |

FOREIGN PATENT DOCUMENTS

| | | | |
|---|---|---|---|
| KR | 10-2018-0024621 | A | 3/2018 |
| KR | 10-2035986 | B1 | 10/2019 |
| KR | 10-2020-0024383 | A | 3/2020 |

* cited by examiner

*Primary Examiner* — Jacinta M Crawford
*Assistant Examiner* — Donna J. Ricks
(74) *Attorney, Agent, or Firm* — Lewis Roca Rothgerber Christie LLP

(57) ABSTRACT

An electronic device includes: a host configured to output image data and a timing control signal in response to an image intended to be displayed; a display driver IC coupled to the host through a first interface and a second interface and configured to output a data signal based on the image data; and a display configured to display an image based on the data signal, wherein the host is configured to output the image data and the timing control signal through any one of the first interface and the second interface depending on a display mode.

14 Claims, 5 Drawing Sheets

ELECTRONIC DEVICE HAVING MULTIPLE INTERFACES AND METHOD OF DRIVING THE SAME

CROSS-REFERENCE TO RELATED APPLICATION

The present application claims priority to and the benefit of Korean patent application No. 10-2019-0109587 filed on Sep. 4, 2019, the entire disclosure of which is incorporated herein in its entirety by reference.

BACKGROUND

1. Field

Aspects of some example embodiments of the present disclosure relate to an electronic device and a method of driving the electronic device.

2. Related Art

A Mobile Industry Processor Interface (MIPI) is a display protocol for portable electronic devices. The MIPI supports two display modes, that is, a video mode and a command mode.

In the video mode, image data may be transmitted in real time from a host to a display driver IC (DDI). In the video mode, even when the image to be transmitted to the display driver IC is a still or static image, the host may repeatedly transmit the same still or static image to the display driver IC. Therefore, the video mode may be utilized for displaying a video image, but may lead to inefficient power consumption of the host when the still images are displayed In the command mode, the start of transmission of the image data may be controlled by a tearing effect (TE) signal. When the still image is intended to be displayed in a display, the display driver IC may periodically read the still image from a frame buffer mounted on the display driver IC and transmit the read still image to the display. While the still image is being displayed without being updated, no image data may be transmitted from the host to the display driver IC. However, such a command mode may utilize a frame buffer with a relatively large capacity, which may increase manufacturing cost.

The above information disclosed in this Background section is only for enhancement of understanding of the background and therefore the information discussed in this Background section does not necessarily constitute prior art.

SUMMARY

Aspects of some example embodiments of the present disclosure relate to an electronic device and a method of driving the electronic device, and for example, to an electronic device and a method of driving the electronic device, which enable a host to transmit a mode change signal to a display driver IC through an interface that is provided separately from a Mobile Industry Processor Interface (MIPI).

Some example embodiments of the present disclosure may include an electronic device and a method of driving the electronic device, which enable a host to transmit a mode change signal to a display driver IC through an interface that is provided separately from a MIPI.

Some example embodiments of the present disclosure may include an electronic device and a method of driving the electronic device, in which a display driver IC detects a mode change of a host through a mode change signal received from the host and a display is controlled so as to output an image depending on the changed display mode.

According to some example embodiments of the present disclosure, an electronic device may include a host configured to output image data and a timing control signal in response to an image intended to be displayed, a display driver IC coupled to the host through a first interface and a second interface and configured to output a data signal based on the image data, and a display configured to display an image based on the data signal. The host may output the image data and the timing control signal through any one of the first interface and the second interface depending on a display mode.

According to some example embodiments, the host may output the image data and the timing control signal through the first interface when the image data is video image data, and may output the image data and the timing control signal through the second interface when the image data is still image data.

According to some example embodiments, the still image data may be image data for Always on Display (AoD).

According to some example embodiments, the display driver IC may include a frame buffer configured to store the image data.

According to some example embodiments, when the image data is received through the first interface, the display driver IC may generate the data signal from the image data and output the data signal to the display.

According to some example embodiments, when the image data is received through the second interface, the display driver IC may store the image data in the frame buffer and generate the data signal by reading the image data from the frame buffer.

According to some example embodiments, when the image data is received through the second interface, the display driver IC may generate a timing control signal and output the data signal to the display based on the timing control signal.

According to some example embodiments, the image data and the timing control signal may be output once through the second interface while the still image data is being displayed.

According to some example embodiments, the first interface may be a Mobile Industry Processor Interface (MIPI), and the second interface may be an independent transmission line that is different from the first interface.

According to some example embodiments of the present disclosure, in a method of driving an electronic device including a host and a display driver IC coupled to the host through a first interface and a second interface, the method may include: outputting, by the host, image data and a timing control signal to the display driver IC through any one of the first interface and the second interface depending on a display mode; and outputting, by the display driver IC, a data signal based on the image data.

According to some example embodiments, outputting the image data and the timing control signal to the display driver IC may include outputting the image data and the timing control signal through the first interface when the image data is video image data; and outputting the image data and the timing control signal through the second interface when the image data is still image data.

According to some example embodiments, the display driver IC may include a frame buffer configured to store the image data.

According to some example embodiments, outputting the data signal based on the image data may include generating the data signal from the image data when the image data is received through the first interface; and outputting the generated data signal.

According to some example embodiments, outputting the data signal based on the image data may include storing the image data in the frame buffer when the image data is received through the second interface; generating the data signal by reading the image data from the frame buffer; and outputting the generated data signal.

According to some example embodiments, outputting the data signal based on the image data may include generating a timing control signal; and outputting the data signal to the display based on the timing control signal.

DETAILED DESCRIPTION

Figure 1:
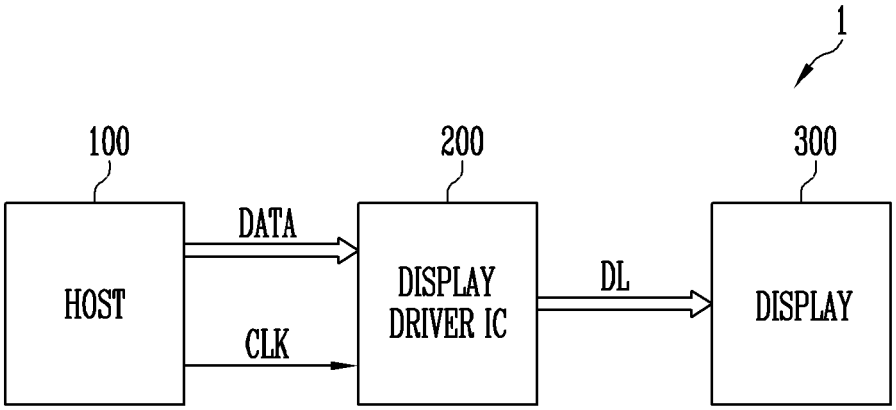
FIG. 1 is a block diagram schematically illustrating the configuration of an electronic device according to some example embodiments of the present disclosure.

Further details and characteristics of various example embodiments are illustrated and described in the detailed descriptions and drawings.

Aspects and features of embodiments according to the present disclosure, and methods for achieving the same will become more clear with reference to example embodiments described later in more detail together with the accompanying drawings. However, it is to be noted that embodiments according to the present disclosure are not limited to the embodiments but can be embodied in various other ways. In this specification, "connected/coupled" refers to one component not only directly coupling another component but also indirectly coupling another component through an intermediate component. Furthermore, in drawings, portions unrelated to the present disclosure have been omitted to clarify the description of the present disclosure, and the same reference numerals are used throughout the different drawings to designate the same or similar components.

Hereinafter, an electronic device and a method of driving the electronic device according to some example embodiments of the present disclosure will be described with reference to the drawings related to the embodiments of the present disclosure.

An electronic device according to some example embodiments of the present disclosure may include at least one of, for example, a smartphone, a tablet PC, a mobile phone, a video phone, an electronic-book reader, a desktop PC, a laptop PC, a netbook computer, a workstation, a server, a PDA, a portable multimedia player (PMP), an MP3 player, a medical device, a camera, or a wearable device. The wearable device may include at least one of an accessory type (e.g., a watch, a ring, a bracelet, an ankle bracelet, a necklace, glasses, a contact lens, or a head-mounted device (HMD)), a fabric- or garment-integrated type (e.g., an electronic garment), a body-attached type (e.g., a skin pad or a tattoo), or a bio-implantable circuit. In some embodiments, the electronic device may include at least one of, for example, a television, a digital video disk (DVD) player, an audio, a refrigerator, an air conditioner, a cleaner, an oven, a microwave oven, a washing machine, an air cleaner, a set-top box, a home automation control panel, a security control panel, a media box (e.g., Samsung HomeSync™, Apple TV™, or Google TV™), a game console (e.g., Xbox™ or PlayStation™), an electronic dictionary, an electronic key, a camcorder, or an electronic picture frame.

According to some example embodiments, the electronic device may include at least one of various medical devices (e.g., various types of portable medical measurement devices (e.g., a blood glucose monitoring device, a heartbeat measuring device, a blood pressure measuring device, a body temperature measuring device, and the like), a magnetic resonance angiography (MRA), a magnetic resonance imaging (MRI), a computed tomography (CT), a scanner, a ultrasonic device, and the like), a navigation device, a global navigation satellite system (GNSS), an event data recorder (EDR), a flight data recorder (FDR), a vehicle infotainment device, electronic equipment for vessels (e.g., a navigation system, a gyrocompass, and the like), avionics, a security device, a head unit for vehicles, an industrial or home robot, a drone, an ATM of a financial institution, a points of sales (POS) of a store, or IoT devices (e.g., a light bulb, various types of sensors, a sprinkler device, a fire alarm, a thermostat, a street lamp, a toaster, exercise equipment, a hot water tank, a heater, a boiler, and the like).

According to some example embodiments of the present disclosure, the electronic device may include at least one of parts of furniture, a building/structure, or an automobile, an electronic board, an electronic signature receiving device, a projector, or various measuring instruments (e.g., a water meter, an electricity meter, a gas meter, a wave meter, and the like). According to some example embodiments, the electronic device may be a flexible electronic device or may be a combination of two or more of the above-described various devices. An electronic device according to some example embodiments of the present disclosure is not limited to the above-described devices.

In this specification, the term "user" may refer to a person who uses an electronic device or a device (e.g., an artificial intelligence electronic device) that uses the electronic device.

Figure 2:
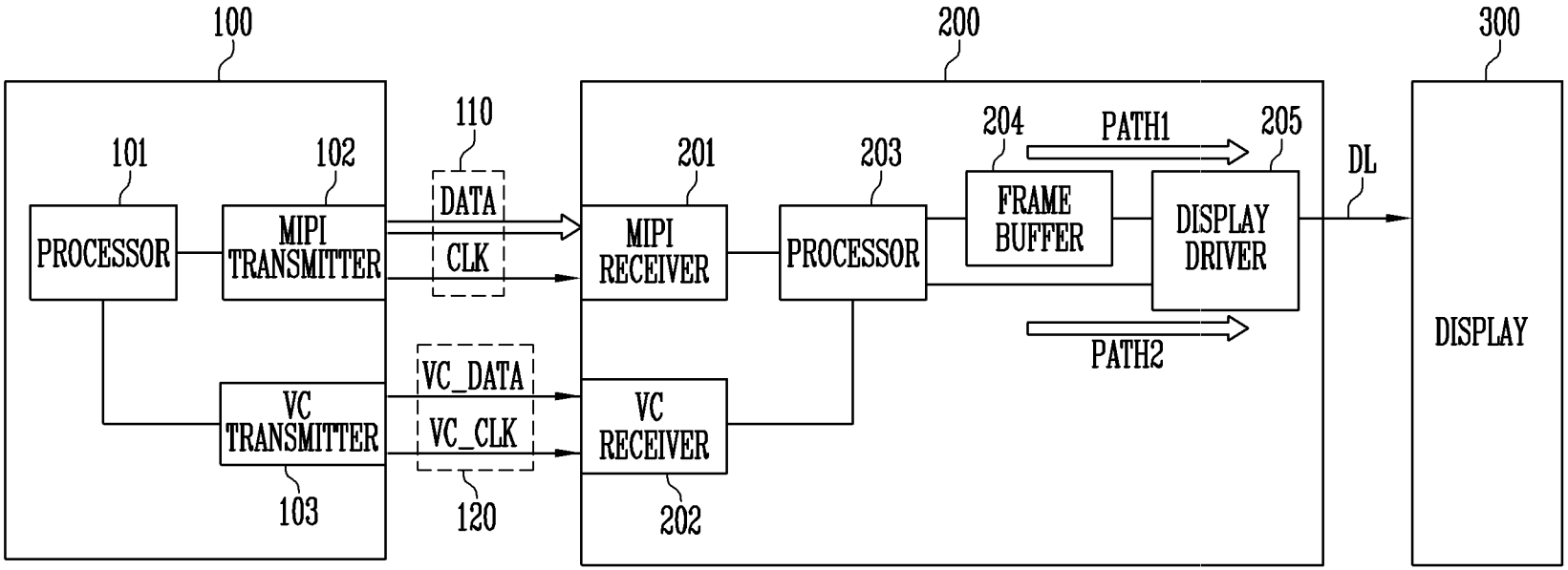
FIG. 2 is a block diagram more specifically illustrating the configuration of an electronic device according to some example embodiments of the present disclosure.
Figure 3:
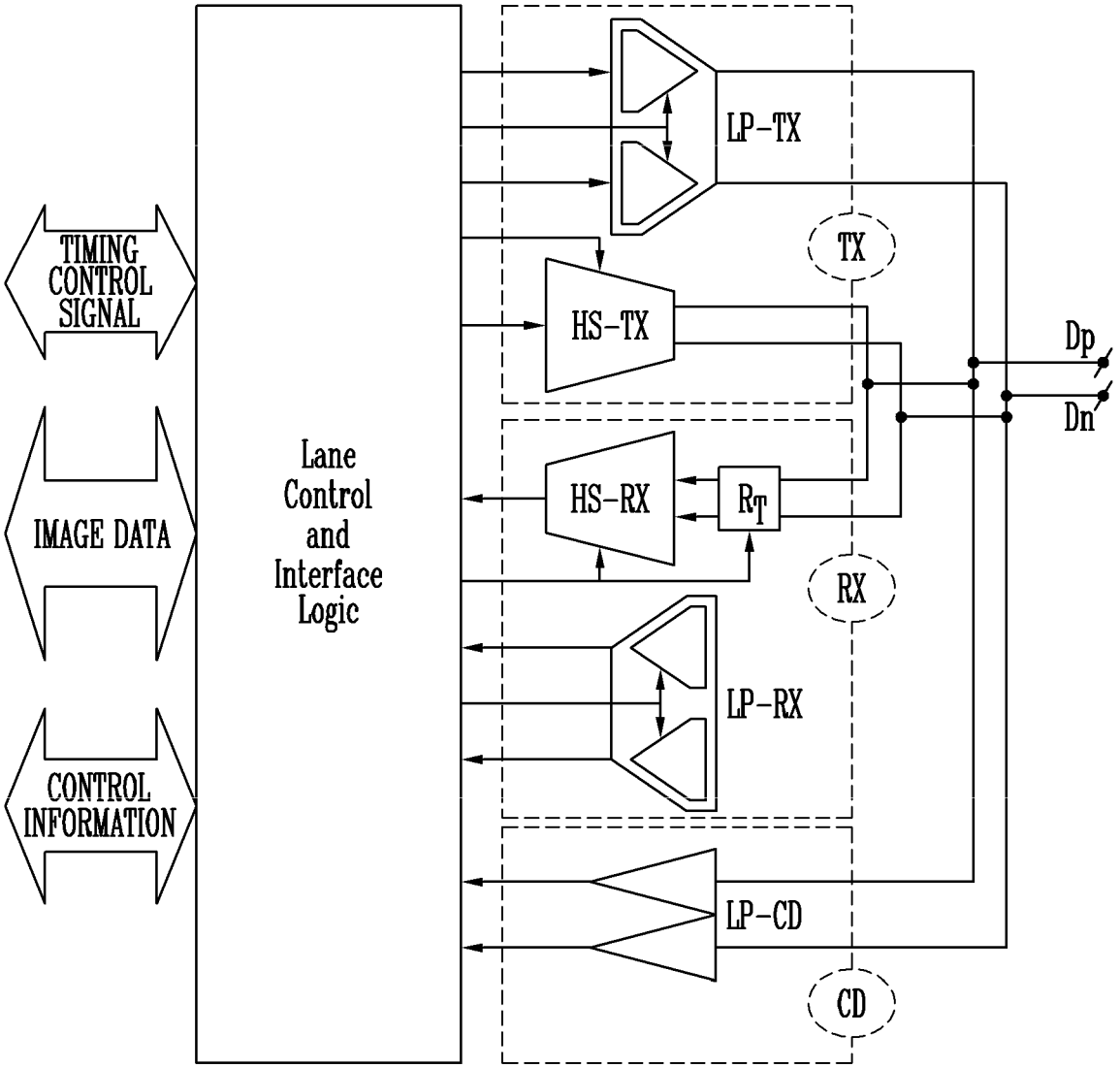
FIG. 3 is a diagram illustrating the universal lane module functions of a MIPI.

FIG. 1 is a block diagram schematically illustrating the configuration of an electronic device according to some example embodiment of the present disclosure. FIG. 2 is a block diagram illustrating the configuration of an electronic device according to some example embodiment of the present disclosure. FIG. 3 is a diagram illustrating universal lane module functions of a MIPI.

The electronic device 1 may be an arbitrary device capable of displaying a video stream, for example, a still image or a video image, in a display 300. Referring to FIG. 1, the electronic device 1 according to some example embodiment of the present disclosure may include a host 100, a display driver IC 200, and the display 300.

The host 100 may control the operation of the display driver IC 200. According to some example embodiments, the host 100 may be implemented as an integrated circuit, a system on chip (SoC), an application processor (AP), or a mobile AP. The host 100 may include a processor 101, a MIPI transmitter (MIPI Tx) 102, and a VC transmitter 103.

The processor 101 may control the operation of other components of the host 100, for example, the MIPI transmitter 102, the VC transmitter 103, and the like. The processor 101 may process the image data to be transmitted to the display driver IC 200 through the MIPI transmitter 102 or the VC transmitter 103, and may control the transmission of the processed image data to the display driver IC 200.

Also, the processor 101 may control the transmission of a timing control signal for the display driver IC 200 through the MIPI transmitter 102 or the VC transmitter 103. The timing control signal may include, for example, a vertical synchronization signal, a horizontal synchronization signal, a data enable signal, a clock signal, and the like.

The vertical synchronization signal is a signal for defining the length of one frame, and the pulse of the vertical synchronization signal may be generated at the start point of one frame. The horizontal synchronization signal may be a signal for defining a period during which a data signal for each row of pixels of the display 300 is supplied. The data enable signal is a signal for defining a period during which a data signal is output to the display 300, and the data enable signal may have a high logic level while the data signal is being output. The clock signal may have a square waveform in which a high logic level and a low logic level are repeated.

According to some example embodiment of the present disclosure, the processor 101 may determine whether or not the image data to be transmitted to the display driver IC 200 is still image data or video image data, and may set a display mode to a virtual control (VC) mode or a video mode depending on the determination result. The still image data may be, for example, an AoD image, but is not limited thereto.

The processor 101 may control the transmission of the image data depending on the display mode. According to some example embodiment of the present disclosure, when the image data to be transmitted to the display driver IC 200 is video image data, the processor 101 may operate in the video mode. However, the technical spirit of embodiments according to the present disclosure are not limited thereto, and the processor 101 may operate in the video mode even when the image data is still image data. Here, the still image data may be still image data excluding the image data for an AoD image.

In the video mode, the processor 101 may transmit the image data to the display driver IC 200 in real time (that is, at preset intervals). In such embodiments, the processor 101 may transmit the image data and the timing control signal to the display driver IC 200 through the MIPI transmitter 102.

When the image data to be transmitted to the display driver IC 200 is still image data, the processor 101 may operate in the virtual control mode. Here, the still image may be an AoD image, but embodiments according to the present disclosure are not limited thereto.

In the virtual control mode, the processor 101 may transmit the image data to the display driver IC 200 once. According to some example embodiment of the present disclosure, the processor 101 may transmit the image data and the timing control signal to the display driver IC 200 through the VC transmitter 103. During the virtual control mode, the processor 101 may operate in a sleep mode (or standby mode) in practice after it outputs the image data and the timing control signal once.

Generally, video image data is displayed in the entire display area of the display 300, but still image data, such as an AoD image, may be displayed in only part of the display area of the display 300. Accordingly, the image data that the VC transmitter 103 transmits to the display driver IC 200 in the virtual control mode for controlling the output of the AoD image may have a smaller capacity than the image data that the MIPI transmitter 102 transmits to the display driver IC 200 in the video mode. However, the technical spirit of embodiments according to the present disclosure are not limited thereto.

The MIPI transmitter 102 is a terminal that is provided in order to transmit data from the host 100 to the display driver IC 200 based on MIPI specifications. The MIPI transmitter 102 may transmit the image data processed by the processor 101 and the timing control signal to the display driver IC 200 in the video mode, or may transmit various kinds of control information generated by the processor 101 to the display driver IC 200.

The MIPI transmitter 102 includes a single clock lane module and one or more data lane modules. In FIG. 3, the detailed configuration of only a single data lane module is illustrated, but each of the lane modules may include the components illustrated in FIG. 3.

For example, each lane module includes a high-speed transmitter HS-TX, a high-speed receiver HS-RX, a low-power transmitter LP-TX, a low-power receiver LP-RX, and a low-power contention detector LP-CD, as illustrated in FIG. 3. The transmitter TX includes the low-power transmitter LP-TX and the high-speed transmitter HS-TX, the receiver RX includes the high-speed receiver HS-RX, the low-power receiver LP-RX, and a termination resistor (or termination impedance RT), and the contention detector CD includes the low-power contention detector LP-CD. The termination resistor RT may be enabled only when each lane module is in a high-speed reception mode.

The transceiver of FIG. 3 may be controlled by lane control and interface logic. The present specification refers to the specifications provided by a MIPI alliance.

The present disclosure describes an example in which the host 100 includes the MIPI transmitter 102, but the host 100 may include a transmitter using various specifications, such as a Mobile Display Digital Interface (MDDI), a display port, an embedded display port, and the like, other than the MIPI specifications.

The VC transmitter 103 is a terminal that is provided in order to transmit data from the host 100 to the display driver IC 200 along with the MIPI transmitter 102. According to some example embodiment of the present disclosure, the VC transmitter 103 may not follow the MIPI specifications.

The VC transmitter 103 may transmit the image data processed by the processor 101 and the timing control signal to the display driver IC 200 in the virtual control mode, or may transmit various kinds of control information generated by the processor 101 to the display driver IC 200.

In the present specification, the VC transmitter 103 is described as a separate component, but the VC transmitter 103 may be provided as a single component by being combined with the processor 101.

The host 100 and the display driver IC 200 may communicate with each other through a first interface 110. According to some example embodiment of the present disclosure, the first interface 110 is a MIPI interface configured to couple the MIPI transmitter 102 of the host 100 to the MIPI receiver 201 of the display driver IC 200, and may include one or more data lanes DATA and a single clock lane CLK. In FIG. 1 and FIG. 2, a single data lane DATA is illustrated, but multiple data lanes Dp and Dn may be provided as illustrated in FIG. 3.

The clock lane CLK may transmit a clock signal having a different frequency and swing level, which is output from the MIPI transmitter 102, to the display driver IC 200 depending on an operation mode (e.g., a low-power (LP) mode and a high-speed (HS) mode). Each of the data lanes DATA may transmit the image data having a different frequency and swing level, which is output from the MIPI transmitter 102 depending on the operation mode, to the display driver IC 200.

Also, the host 100 and the display driver IC 200 may communicate with each other through a second interface 120. The second interface 120 is an independent interface (transmission line) that is provided separately from the first interface 110 (MIPI interface). The second interface 120 may be different from the first interface 110, and may not follow the MIPI specifications.

The second interface 120 is a dedicated line for transmitting a mode change signal HS from the host 100. According to some example embodiment of the present disclosure, the second interface 120 is an interface that couples the VC transmitter 103 of the host 100 to the VC receiver 202 of the display driver IC 200, and may include a virtual control data line VC_DATA and a virtual control clock line VC_CLK. The virtual control clock line VC_CLK may transmit the timing control signal output from the VC transmitter 103 to the display driver IC 200, and the virtual control data line VC_DATA may transmit the image data output from the VC transmitter 103 to the display driver IC 200.

The display driver IC 200 may process the image data received from the host 100 through the first interface 110 or the second interface 120 and generate a data signal corresponding to the processing result. The display driver IC 200 transmits the data signal to the display 300 through an interface line coupled to the display 300, for example, through a data line DL, thereby enabling an image corresponding to the image data to be output to the display 300.

The display driver IC 200 may select any one of a virtual control mode processing path PATH1 and a video mode processing path PATH2, implemented in the display driver IC 200, depending on the display mode, and may transmit the data signal to the display 300 through the selected path.

The display driver IC 200 may include the MIPI receiver 201, the VC receiver 202, a processor 203, a frame buffer 204, and a display driver 205.

The MIPI receiver 201 may receive the timing control signal and the image data from the host 100 through the first interface 110 and transmit the same to the processor 203. The MIPI receiver 201 includes a single clock lane module and one or more data lane modules. Each of the lane modules includes transceivers HS-TX, HS-RX, LP-TX and LP-RX and a low-power contention detector LP-CD, as illustrated in FIG. 3.

The VC receiver 202 may receive the timing control signal and the image data from the host 100 through the second interface 120 and transmit the same to the processor 203. In the present specification, the VC receiver 202 is described as a separate component, but the VC receiver 202 may be mounted on a single chip along with the MIPI receiver 201 and/or the processor 203, or may be provided as a single component.

The processor 203 may process the image data based on the timing control signal received from the MIPI receiver 201 or the VC receiver 202, thereby generating an output image signal. Also, the processor 203 may identify whether the display mode is a virtual control mode or a video mode, and may determine whether it passes through the frame buffer 204 (virtual control mode) or bypasses the frame buffer 204 (video mode) when it transmits the output image signal to the display 300.

For example, the processor 203 may identify that the display mode is a video mode when the image data and the timing control signal are received through the first interface 110. Also, the processor 203 may identify that the display mode is a virtual control mode when the image data and the timing control signal are received through the second interface 120.

When the display mode is identified to be the virtual control mode, the processor 203 may transmit the data signal to the display 300 through the virtual control mode processing path PATH1 that is via the frame buffer 204. That is, the processor 203 may transmit the processed image data and the timing control signal to the display driver 205 via the frame buffer 204 in the virtual control mode. In other words, the processor 203 stores the received image data in the frame buffer 204 in the virtual control mode, thereby enabling the display driver 205 to read the image data from the frame buffer 204.

In the virtual control mode, the host 100 transmits the image data and the timing controller to the display driver IC 200 through the second interface 120 once. The image data transmitted from the host 100 is stored in the frame buffer 204 through the processor 203 as described above. The display driver 205 may generate a data signal by reading the image data stored in the frame buffer 204 in units of frame periods and supply the generated data signal to the display 300.

In such embodiments, the processor 203 may generate a timing control signal and supply the same to the display driver 205. When the timing control signal is not supplied from the host 100 during the virtual control mode, the data signal output timing of the display driver 205 may not be controlled. Therefore, the processor 203 may autonomously generate a timing control signal by referring to the timing control signal that was previously supplied from the host 100, and may transmit the same to the display driver 205.

While it operates in the virtual control mode, the host 100 supplies the image data and the timing control signal to the display driver IC 200 only once. After that, because the timing control signal and the image data are directly supplied to the display 300 through the display driver IC 200, the host 100 may stop the display operation and enter a sleep mode in practice. Accordingly, while the host 100 operates in the virtual control mode, there is no power consumption by the host 100, and the display operation is controlled by the display driver IC 200 having relatively lower power consumption, whereby the electronic device 1 may be driven with low power.

When the display mode is identified to be a video mode, the processor 203 may transmit the data signal to the display 300 through the video mode processing path PATH2 that is not via the frame buffer 204. That is, the processor 203 may transmit the image data processed by itself directly to the display driver 205 without passing through the frame buffer 204 in the video mode. When it operates in the video mode, the processor 203 processes the image data and the timing control signal, received from the host 100, in real time and transmits the same to the display 300 through the video mode processing path PATH2.

The frame buffer 204 receives and stores the image data under the control of the processor 203. As described above, the frame buffer 204 may store the image data transmitted from the processor 203 in the virtual control mode.

The image data stored in the frame buffer 204 in the virtual control mode is still or static image data, and may be, for example, data for an AoD image. When the AoD image is displayed in only part of the entire display area of the display 300, the image data may include only the data for the corresponding area. Accordingly, the size of the image data stored in the frame buffer 204 may be relatively small.

As described above, embodiments according to the present disclosure may implement the electronic device 1 using the frame buffer 204 having a small capacity. Accordingly, the size of the electronic device 1 according to embodiments of the present disclosure may be reduced, and the manufacturing cost thereof may be reduced.

The frame buffer 204 may be implemented as graphic memory. According to some example embodiment of the present disclosure, the read operation of the frame buffer 204 may be performed by the display driver 205. For example, the display driver 205 may read the image data from the frame buffer 204 during a section in which a frame scan signal has a high level.

The display driver 205 generates a data signal by processing the image data transmitted via the frame buffer 204 or transmitted directly from the processor 203. The display driver 205 may supply the data signal to the display 300 at the preset timing based on the timing control signal. For example, the display driver 205 outputs the data signal in units of frames defined by a vertical synchronization signal, in which case the display driver 205 may output the data signal to the display 300 while the data enable signal has a high logic level.

The display 300 may display an image corresponding to the data signal transmitted from the display driver IC 200. The display 300 may be implemented as a liquid crystal display (LCD), a light-emitting diode (LED) display, an organic LED (OLED) display, or an active-matrix OLED (AMOLED) display.

Figure 4:
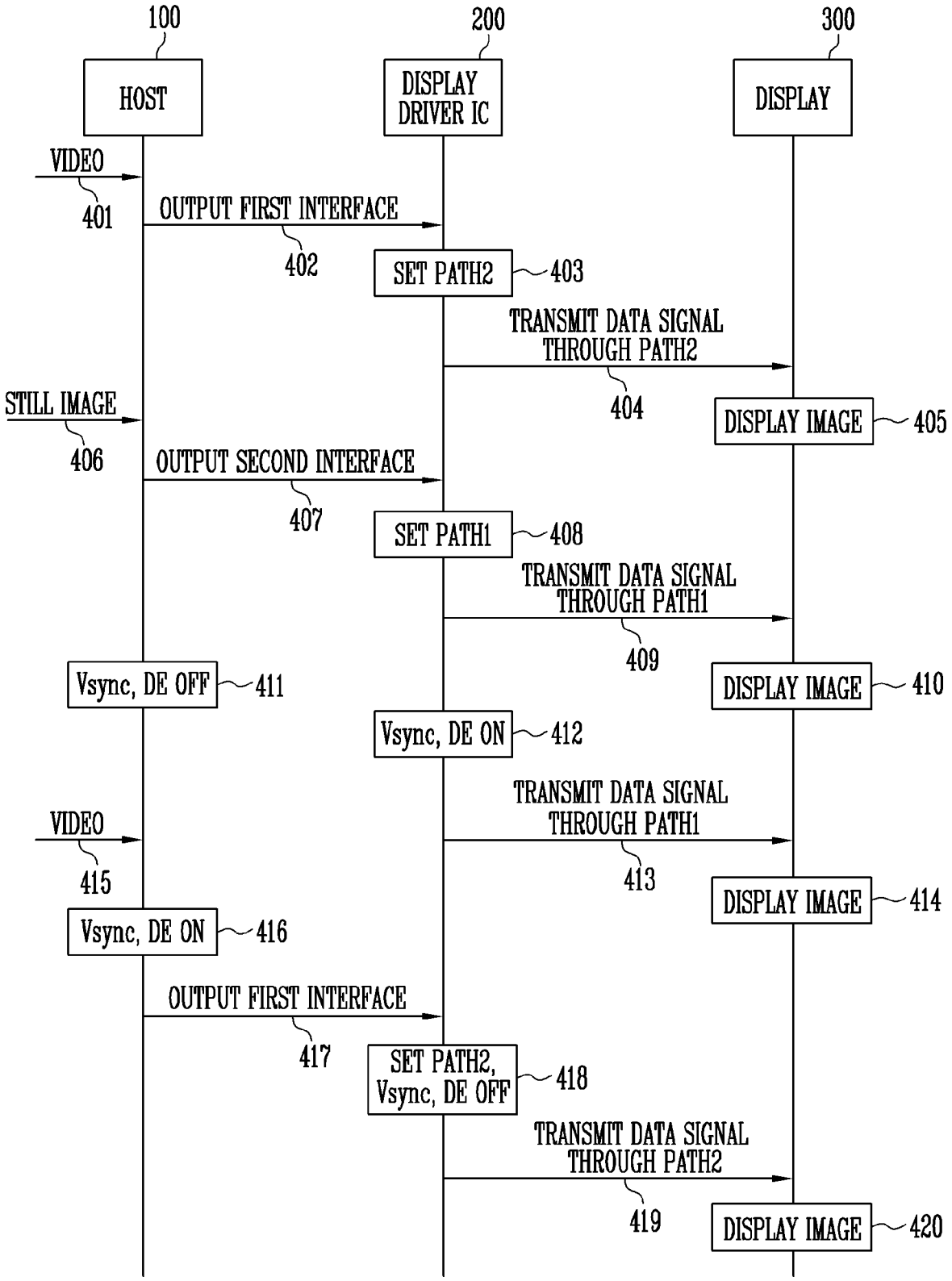
FIG. 4 is a flowchart illustrating a method of driving an electronic device according to some example embodiments of the present disclosure.
Figure 5:
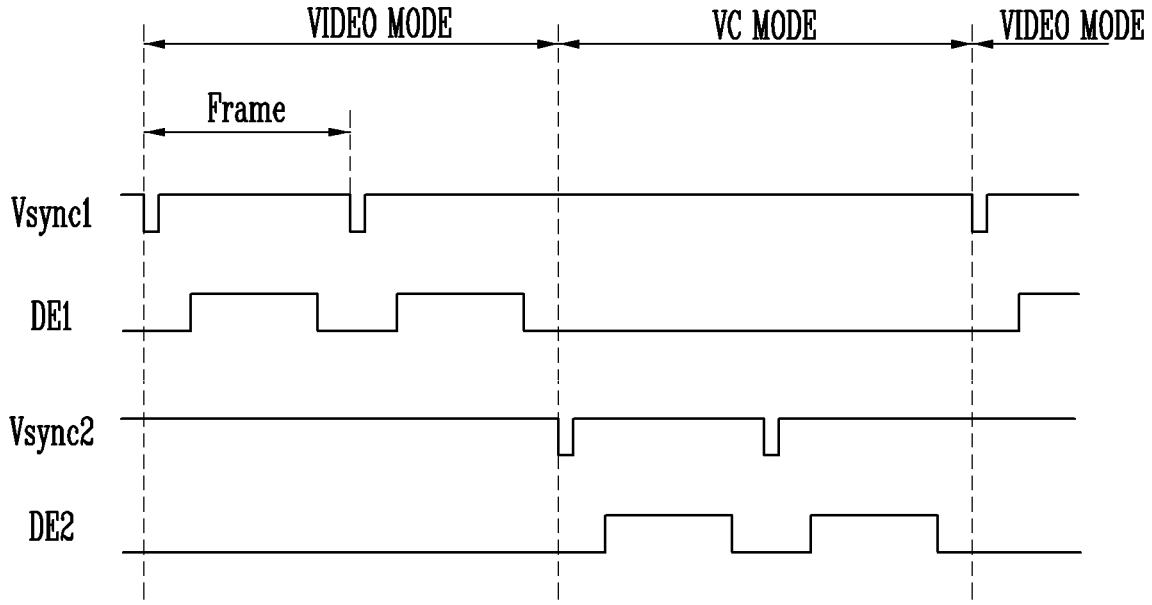
FIG. 5 is a timing diagram illustrating a method of driving an electronic device according to some example embodiments of the present disclosure.

FIG. 4 is a flowchart illustrating a method of driving an electronic device according to some example embodiment of the present disclosure. FIG. 5 is a timing diagram illustrating a method of driving an electronic device according to some example embodiment of the present disclosure. Referring to FIG. 4 and FIG. 5 in conjunction with FIGS. 1 to 3, a process in which video image data and still image data are sequentially displayed in the display 300 is described.

When it intends to display a video image through the display 300 at step 401, the host 100 may output image data and a timing control signal through the first interface 110 at step 402. That is, when it intends to display video image data, the host 100 may set a display mode to a video mode. Accordingly, the host 100 may output the image data through the data lane DATA of the first interface 110 and output the timing control signal through the clock lane CLK of the first interface 110. Here, the timing control signal may include a vertical synchronization signal Vsync1, a data enable signal DE1, and the like.

Referring to the timing diagram illustrated in FIG. 5, while it operates in the video mode, the host 100 transmits the vertical synchronization signal Vsync1 to the display driver IC 200 in units of frames through the clock lane CLK. Also, the host 100 transmits the image data to the display driver IC 200 through the data lane DATA while the data enable signal DE1 having a high logic level is transmitted through the clock lane CLK.

When it receives the image data and the timing control signal through the first interface 110, the display driver IC 200 may process the image data and generate a data signal based thereon. The display driver IC 200 may set the video mode processing path PATH2 at step 403 and transmit the data signal to the display 300 through the video mode processing path PATH2 based on the timing control signal at step 404.

The display 300 may display an image using the received data signal at step 405.

Then, when it intends to display a still image through the display 300 at step 406, the host 100 may output image data and a timing control signal through the second interface 120 at step 407. That is, it intends to display still image data, the host 100 may set the display mode to a virtual control mode. Accordingly, the host 100 may output the image data through the virtual control data line VC_DATA of the second interface 120 and output the timing control signal through the virtual control clock line VC_CLK of the second interface 120. Here, the timing control signal may include a vertical synchronization signal Vsync2, a data enable signal DE2, and the like.

According to some example embodiment of the present disclosure, the host 100 may transmit a control signal for announcing a mode change to the display driver IC 200 through the first interface 110 while the first interface 110 is still activated. Accordingly, through the control signal, the display driver IC 200 may detect that the image data and the timing control signal will be received through the second interface 120, and may activate the second interface 120 or perform an operation for processing the data received through the second interface 120.

When it receives the image data and the timing control signal through the second interface 120, the display driver IC 200 may process the image data and generate a data signal based thereon. The display driver IC 200 may set the virtual control mode processing path PATH1 at step 408 and transmit the data signal to the display 300 through the virtual control mode processing path PATH1 based on the timing control signal at step 409. The image data is processed through the virtual control mode processing path PATH1, whereby the image data may be stored in the frame buffer 204.

The display 300 may display an image using the received data signal at step 410.

While it operates in the virtual control mode, the host 100 does not output any image data and any timing control signal. That is, the host 100 turns off the output of the vertical synchronization signal Vsync1 and the data enable signal DE1 at step 411. Instead of that, during the operation in the virtual control mode, the display driver IC 200 may autonomously generate a timing control signal. To this end, the display driver IC 200 turns on the output of the vertical synchronization signal Vsync2 and the data enable signal DE2 at step 412.

Then, the display driver IC 200 may read the still image data stored in the frame buffer 204 at each frame period based on the vertical synchronization signal Vsync2, and may transmit the data signal to the display 300 at step 413 while the data enable signal DE2 has a high level. The display 300 may display an image using the received data signal at step 414.

After that, when it intends to display a video image through the display 300 again at step 415, the host 100 may turn on the output of the vertical synchronization signal Vsync1 and the data enable signal DE1 at step 416. Then, the host 100 may output image data and a timing control signal through the first interface at step 417.

According to some example embodiment of the present disclosure, the host 100 may transmit a control signal for announcing a mode change to the display driver IC 200 through the second interface 120 while the second interface 120 is still activated. Accordingly, through the control signal, the display driver IC 200 may detect that the image data and the timing control signal will be received through the first interface 110, and may activate the first interface 110 or perform an operation for processing the data received through the first interface 110. For example, after it sets the video mode processing path PATH2, the display driver IC 200 may turn off the autonomous generation of the vertical synchronization signal Vsync2 and the data enable signal DE2 at step 418 and stop reading data from the frame buffer 204. According to some example embodiment of the present disclosure, the display driver IC 200 may delete the image data from the frame buffer 204.

The display driver IC 200 may output the data signal to the display 300 at step 419 based on the image data and the timing control signal received through the first interface 110. The display 300 may display an image using the received data signal at step 420.

An electronic device and a method of driving the electronic device according to the present disclosure may provide a virtual control mode for displaying an Always on Display (AOD) image with low power in the electronic device that follows a MIPI standard.

Also, an electronic device and a method of driving the electronic device according to some example embodiments of the present disclosure may display an image with relatively low power using a display driver IC having a small-capacity frame buffer, thereby reducing the manufacturing cost of the electronic device.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the example embodiments of the present invention.

While aspects of certain example embodiments have been described above, it will be understood to those skilled in the art that the embodiments described are by way of example only. Therefore, it should be understood that the above-described embodiments are only examples in all aspects rather than being restrictive. It is intended that the scope of the present disclosure should be defined by the accompanying claims, and their equivalents, rather than the above-described descriptions, and various modifications, additions and substitutions, which can be derived from the meaning, scope and equivalent concepts of the accompanying claims, fall within the scope of the present disclosure.

What is claimed is:

1. An electronic device, comprising:

a host configured to output image data and a timing control signal in response to an image intended to be displayed;

a display driver IC having a processor coupled to the host through a first interface and a second interface and configured to select from among a first processing path or a second processing path to output a data signal through the selected first or second processing path based on the image data; and a display configured to display an image based on the data signal, wherein the host is configured to output the image data and the timing control signal through any one of the first interface and the second interface depending on a display mode, wherein the processor of the display driver IC is configured to operate in a video mode in response to the image data being output in the display mode corresponding to the first interface, wherein the processor of the display driver IC is configured to operate in a standby mode in response to the image data being output in the display mode corresponding to the second interface, wherein the display driver IC includes a frame buffer configured to store the image data, and wherein the first processing path is via the frame buffer and the second processing path is not via the frame buffer, and wherein, in response to the image data being received through the second interface, the display driver IC is configured to store the image data in the frame buffer, to generate the data signal by reading the image data from the frame buffer, and to output the generated data signal.

2. The electronic device according to claim 1, wherein the host is configured to output the image data and the timing control signal through the first interface when the image data is video image data, and to output the image data and the timing control signal through the second interface when the image data is still image data.

3. The electronic device according to claim 2, wherein the still image data is image data for Always on Display (AoD).

4. The electronic device according to claim 2, wherein when the image data is received through the first interface, the display driver IC is configured to generate the data signal from the image data and to output the data signal to the display.

5. The electronic device according to claim 2, wherein when the image data is received through the second interface, the display driver IC is configured to generate the timing control signal and to output the data signal to the display based on the timing control signal.

6. The electronic device according to claim 5, wherein the image data and the timing control signal are output once through the second interface while the still image data is being displayed.

7. The electronic device according to claim 1, wherein:

the first interface is a Mobile Industry Processor Interface (MIPI), and the second interface is an independent transmission line that is different from the first interface.

8. A method of driving an electronic device, including a host and a display driver IC coupled to the host through a first interface and a second interface, the method comprising:

outputting, by the host, image data and a timing control signal to the display driver IC through any one of the first interface and the second interface depending on a display mode;

selecting, by the display driver IC, a first processing path or a second processing path to output a data signal based on the image data;

outputting, by the display driver IC, the data signal through the selected first or second processing path;

operating, by a processor of the display driver IC, in a video mode in response to the image data being output in the display mode corresponding to the first interface; and operating, by the processor of the display driver IC, in a standby mode in response to the image data being output in the display mode corresponding to the second interface, wherein the display driver IC includes a frame buffer configured to store the image data, and wherein the first processing path is via the frame buffer and the second processing path is not via the frame buffer, and wherein outputting the data signal through the selected first or second processing path further comprises:

storing the image data in the frame buffer when the image data is received through the second interface;

generating the data signal by reading the image data from the frame buffer; and outputting the generated data signal.

9. The method according to claim 8, wherein outputting the image data and the timing control signal to the display driver IC comprises:

outputting the image data and the timing control signal through the first interface when the image data is video image data; and outputting the image data and the timing control signal through the second interface when the image data is still image data.

10. The method according to claim 9, wherein the still image data is image data for Always on Display (AoD).

11. The method according to claim 9, wherein outputting the data signal through the selected first or second processing path further comprises:

generating the data signal from the image data when the image data is received through the first interface; and outputting the generated data signal.

12. The method according to claim 11, wherein outputting the data signal through the selected first or second processing path further comprises:

generating the timing control signal; and outputting the data signal to a display based on the timing control signal.

13. The method according to claim 12, wherein the image data and the timing control signal are output once through the second interface while the still image data is being displayed.

14. The method according to claim 8, wherein:

the first interface is a Mobile Industry Processor Interface (MIPI), and the second interface is an independent transmission line that is different from the first interface.

* * * * *